US007082975B2

(12) United States Patent
Hirai

(10) Patent No.: US 7,082,975 B2
(45) Date of Patent: Aug. 1, 2006

(54) METHOD OF BENDING WOOD MATERIALS AND AN APPARATUS FOR BENDING WOOD MATERIALS

(75) Inventor: Masato Hirai, Komatsushima (JP)

(73) Assignee: Yamamoto Engineering Works Co., Ltd., Komatsushima (JP)

( * ) Notice: Subject to any disclaimer, the term of this patent is extended or adjusted under 35 U.S.C. 154(b) by 333 days.

(21) Appl. No.: 10/756,346

(22) Filed: Jan. 14, 2004

(65) Prior Publication Data

US 2005/0150573 A1 Jul. 14, 2005

(51) Int. Cl.
*B27H 1/00* (2006.01)

(52) U.S. Cl. ..... 144/381; 144/259; 144/261

(58) Field of Classification Search ..... 144/259, 144/261, 262, 380, 381, 2.1; 72/166; 100/906, 100/303–307, 151, 153, 240
See application file for complete search history.

(56) References Cited

U.S. PATENT DOCUMENTS 8,511 A * 11/1851 Johnston ..... 144/261
638,477 A * 12/1899 Scheid ..... 144/261
655,889 A * 8/1900 Ordway ..... 144/261
3,521,553 A * 7/1970 Werner et al. ..... 100/98 R
3,913,474 A * 10/1975 Lewis ..... 100/45
4,759,206 A * 7/1988 Kaneko ..... 72/134
4,875,353 A * 10/1989 Kaneko ..... 72/133

* cited by examiner

*Primary Examiner*—Bena Miller
(74) *Attorney, Agent, or Firm*—Smith Patent Office

(57) ABSTRACT

The method of bending wood materials inserts cylindrical or board shaped wood material of uniform lateral cross-section into a bending template shaping channel via a driving mechanism to bend the wood material in the shaping channel. Further, the bending method of this invention applies pressure to the front end of the wood material via a braking mechanism to limit its movement in the shaping channel and prevent tension fracture on the stretched side of the curved wood material. Wood material, which is pushed from its aft end and movement limited at its front end, is compressed to control the amount of stretching of the extended outer periphery of the wood material undergoing bending and prevent tension fracture.

20 Claims, 6 Drawing Sheets

METHOD OF BENDING WOOD MATERIALS AND AN APPARATUS FOR BENDING WOOD MATERIALS

BACKGROUND OF THE INVENTION

This invention relates to a method and apparatus for bending or curving wood materials, and in particular to a method and apparatus wherein wood material is inserted into the shaping channel of a bending template to form a curved shape.

Wood materials curved in two or three dimensions are used in industrial products of luxurious design. For example, wood materials curved in various shapes are used for furniture such as chairs, religious altars and decorations, door handles, automotive parts such as steering wheels, home electronics, and many types of nursing care equipment.

The method shown in FIG. 1 has been developed as a method of bending wood materials. In this method, wood material W is made to follow the surface contour of a bending template 21 to form a curved shape. Since this method stretches the top surface of the wood material W being curved, it has the drawback that the wood material is easily cracked. This is because the maximum tolerance for stretching wood material W in the direction of the grain is extremely small at only 1% to 2%. Wood materials have a large tolerance for compression in the direction of the grain, on the order of 30%, but with respect to stretching, they are readily disposed to tension fracture. When wood material compression in the direction of the grain exceeds maximum compression tolerance, there is a strong possibility of local cracking and splitting resulting in buckling.

The methods shown in FIGS. 2 and 3 were developed to eliminate the drawback of the method of FIG. 1. In the method shown in FIGS. 2, steel bands 22 are disposed at the outer surface of the wood material W to be shaped. In this configuration, the outer surface of the wood material W is restrained from stretching while an inner template 24 presses down between a pair of rollers 23 to bend the wood material W. In the method of FIG. 3, wood material W is sandwiched between a male template 26 and a female template 25 to produce a curved shape.

However, methods such as those shown in the figures have the following drawbacks.

(1) The surface of the wood material in contact with the steel bands must be planar. This puts restrictions on the cross-sectional shape of wood material to be shaped. For example, cylindrical wood material cannot be processed to produce a curved shape.

(2) The steel bands must curve with the wood material. Since the steel bands are required to have flexibility allowing them to bend, they cannot be made any thicker than necessary. Consequently, the steel bands can stretch during bending and result in the unfortunate case of breaking the wood material. If thicker steel bands are used to avoid stretching, they cannot bend with the wood material to produce a curved shape.

(3) It is extremely difficult to reliably hold the wood material and steel bands firmly together with no shifting. Both ends of the steel bands are in contact with wood material, but the contact regions can be damaged during bending making it easy for the wood material and steel bands to shift. If the steel bands shift and do not firmly hold the wood material, the steel bands cannot limit stretching of the wood material during bending and can be the cause of cracking.

(4) Since steel bands follow the contour of the wood material keeping it from stretching, the wood material cannot bend in three dimensions and the shapes that can be produced are limited. Therefore, bending to efficiently produce various shapes is not possible.

(5) Since wood material processing is one piece at a time, bending cannot be performed efficiently in a continuous fashion. Therefore, processing cost is high and inexpensive production in quantity is difficult.

For the previous reasons, related art methods of bending wood materials are remarkably limited in the freedom to produce various shapes, and with respect to production efficiency, industrial production in quantity is difficult. For fine wooden items such as chairs, the state of the art is manufacture by hand crafting.

The present invention was developed to eliminate related art drawbacks. Thus it is a primary object of the present invention to provide a method of bending wood materials and an apparatus for bending wood materials wherein the wood material for bending is not restricted planar material, wood material of various cross-sectional shapes can be processed into various curved shapes, breaking can be effectively prevented by bending wood material while accurately controlling its stretching, and in addition, wood material can be processed into curved shapes extremely efficiently, inexpensively, and in quantity.

The above and further objects and features of the invention will more fully be apparent from the following detailed description with accompanying drawings.

SUMMARY OF THE INVENTION

The method of bending wood materials of the present invention pushes wood material, having a board shape or cylindrical shape of uniform cross-section, via a driving mechanism into the shaping channel of a bending template to bend the wood material within the shaping channel. In addition, the bending method of the present invention limits wood material movement in the shaping channel by pressing on the front end of the wood material with a braking mechanism to prevent tension fracture on the stretched side of the curved wood material. Wood material, which has its aft end pushed and its front end restrained in movement, is thereby compressed during bending to restrict the amount of stretching of its outer periphery and prevent tension fracture.

In the wood material processing method described above, the wood material for bending is not limited to planar shapes, and wood material of various cross-sectional shapes can be processed into various curved shapes. Further, bending while accurately limiting the amount of wood material stretching can effectively prevent tension fracture. In addition, this method has the characteristic that curve shaped wood material can be extremely efficiently and inexpensively produced in quantity. This is because the wood material processing method pushes cylindrical or board shaped wood material with the driving mechanism to insert it into the bending template shaping channel, bends the wood material within the shaping channel while restraining its movement in the shaping channel by pressing on the front end of the wood material with the braking mechanism, and compresses the wood material being shaped to limit the amount of stretching of the periphery during bending.

It is preferable for wood material inserted into the shaping channel of the bending template to be pre-processed to make it pliable. Wood material processed to be pliable bends easily and is smoothly processed into a curved shape within the bending template shaping channel. Wood materials can be heat processed for pliability. In addition, wood material inserted into the bending template can also be heated during insertion into the shaping channel.

The apparatus for bending wood materials of the present invention is provided with a bending template having a shaping channel in which wood material having a board shape or cylindrical shape of uniform cross-section is inserted and shaped, a driving mechanism which pushes the wood material to insert it into the bending template shaping channel, and a braking mechanism which presses on the front end of the wood material inserted into the bending template shaping channel via the driving mechanism to limit its movement in the shaping channel. The driving mechanism pushes the wood material into the bending template shaping channel and the braking mechanism presses against the front end of the wood material. Wood material thereby passes in and out of the shaping channel while the amount of stretching of the wood material's stretched side is controlled during bending.

In the apparatus for bending wood materials of the present invention, wood material movement can be restrained by synchronizing the braking mechanism with the driving mechanism. In addition, wood material movement can also be restrained by applying a prescribed amount of pressure with the braking mechanism to the front end of the wood material moving in the shaping channel. The driving mechanism can use a driving piston to push the wood material and insert it into the shaping channel. The region of the shaping channel of the bending template where a driving piston inserts wood material can have a straight-line shape. The shaping channel of a bending template to form wood material into a circular arc shape can have a circular arc shaped region.

DETAILED DESCRIPTION OF THE INVENTION

Figure 1:
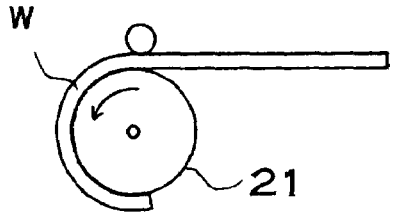
FIG. 1 (PRIOR ART)
FIG. 1 is an abbreviated view showing a related art method of bending wood materials.
Figure 2:
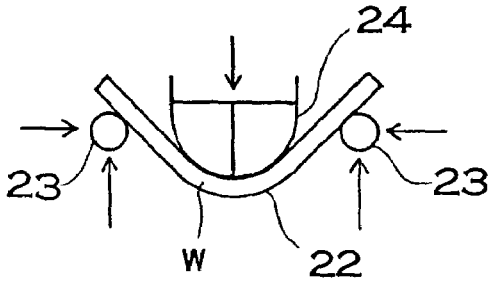
FIG. 2 (PRIOR ART)
FIG. 2 is an abbreviated view showing another related art method of bending wood materials.
Figure 3:
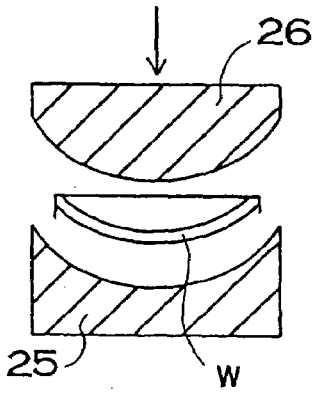
FIG. 3 (PRIOR ART)
FIG. 3 is an abbreviated view showing another related art method of bending wood materials.

The method of bending wood materials of the present invention pushes wood material, having a board shape or cylindrical shape of uniform cross-section, via a driving mechanism into the shaping channel of a bending template to bend the wood material within the shaping channel. The front end of wood material moving in the shaping channel is pressed against by a braking mechanism to limit its movement, compress the wood material, limit the amount of stretching of the outer periphery of wood material during bending, and prevent tension fracture due to stretching.

In the bending method of the present invention, wood material having a board shape or cylindrical shape of essentially uniform cross-section is used as the wood material to be processed. The cross-section of the wood material may be a shape such as square, rectangular, circular, elliptical, or triangular. Further, a lengthwise groove along what will become the inner curved periphery can also be established in the approximately uniform cross-section wood material to make it easier to bend. All wood materials that can possibly be curved by a bending method, such as beech, Japanese oak, Japanese ash, elm, thorn paulownia, larch, oak, white oak, red oak, ash, huckleberry, walnut, rubber tree, matoa, teak, mahogany, ebony, rosewood, maple, cedar, and cypress can be used as wood materials for shaping.

The wood material to be processed can be treated to improve pliability and allow the bending process to proceed more smoothly. A treatment to improve pliability heats the wood material to 100° C. to 180° C. Wood material can be heated for pliability processing by means such as steam, high frequency, or microwaves. Pliability processing via heat treatment softens the wood material making it easier to bend, but room temperature methods such as chemical processing which can achieve the same pliability as heat treatment may also be used. Wood material is inserted into the bending template after pliability processing, or pliability processing can also be performed by the bending template. Wood material, heated for pliability processing, is inserted into the shaping channel and shaped in a curved fashion. Wood material shaped in a curved fashion in the shaping channel can be cooled within the shaping channel to retain its curved form. Wood material coming out of the shaping channel may also be placed in another shape retaining template and cooled to maintain its curved shape.

Wood material, which has or has not been processed to improve pliability, is pushed in the direction of its grain by the driving mechanism into the shaping channel of the bending template. A driving piston can be used by the driving mechanism to press against the aft end of the wood material. However, any mechanism which can push wood material and insert it into the shaping channel can be used. For example, a pressure piece at the end of an arm that applies pressure to the wood material and inserts it into the bending template shaping channel can be used. The present invention applies pressure to the front end of the wood material with the braking mechanism while the driving mechanism pushes the aft end. This limits the amount of movement due to pushing by the driving mechanism. Therefore, a device is used as the driving mechanism which can insert wood material in its grain direction into the bending template shaping channel while being compressed by the braking mechanism which limits the amount of movement due to pushing.

The driving mechanism pushes wood material lengthwise to insert it into the shaping channel of the bending template. The bending template is made with the same cross-sectional area as the wood material. This type of bending template can prevent of wood material inserted in the shaping channel from buckling due to local cracking and in the lateral direction. However, since bending conditions vary depending on factors such as wood type, pliability, and shape, the cross-sectional shape of the shaping channel and the wood material are not necessarily the same. The cross-sectional shape of the shaping channel can be larger or smaller than the cross-sectional shape of the wood material.

The driving mechanism uses a driving piston to push against the aft end of the wood material while it moves in the shaping channel. The driving piston applies pressure uniformly to the entire surface of the aft end of the wood material to push it into the bending template shaping channel. The driving mechanism is not specifically limited to a driving piston to move the wood material in the shaping channel. However, the driving mechanism can include devices such as a hydraulic cylinder, an electrical solenoid, a rack and pinion combination, or a nut and screw-thread driving mechanism. In a driving mechanism with a rack and pinion combination, a driving piston is connected to one end of the rack, the rack is moved in the lengthwise direction by the pinion, and the driving piston is moved along the shaping channel by movement of the rack in the lengthwise direction. In a driving mechanism with a nut and screw-thread combination, a driving piston is connected to one end of the screw-thread, the nut is rotated by a device such as a motor to move the screw-thread in the lengthwise direction, and the driving piston is moved along the shaping channel by lengthwise movement of the screw-thread.

The driving mechanisms described above are suitable for pushing wood material into a straight-line shaping channel. However, the driving mechanism can also push wood material into a curved shaping channel. This type of driving mechanism moves wood material along the shaping channel by providing the driving mechanism with a device such as an actuating arm. The driving mechanism actuating arm inserts inside the shaping channel through a lengthwise slit provided along the shaping channel, and moves a driving piston at the end of the arm. This type of actuating arm is actuated by a driving mechanism provided outside the shaping channel which rotates the arm to move the driving piston.

The present invention can also bend wood material in a 3-dimensional shape such as a spiral. The bending template for this has a wood material shaping channel with the shape of a 3-dimensional solid body. In a 3-dimensional solid shaping channel, the driving piston pushes wood material in a straight-line section or in a 3-dimensional solid shaping channel. A driving mechanism provided with previously mentioned devices such as a hydraulic cylinder, a rack and pinion, or a nut and screw-thread can push wood material in a straight-line shaping channel. A driving mechanism, configured to move a driving piston at the end of an arm inserted through a slit in the shaping channel, can push wood material in a 3-dimensional solid shaping channel. In this type of driving mechanism, the arm is rotated while also moving it along the axis of the spiral to move the end of the arm along the shaping channel.

Further, a driving mechanism may also use transfer rollers or transfer belts to sandwich wood material from both sides and push it into the shaping channel. A driving mechanism provided with transfer rollers has a plurality of rollers disposed in parallel rows on both sides of the wood material. The plurality of rollers arranged in rows are aligned to move wood material into the shaping channel. The plurality of rollers sandwich the wood material from both sides and are rotated to push the wood material into the bending template shaping channel. A driving mechanism provided with transfer belts has conveyor belts driven by rollers disposed on opposite sides of the wood material. A pair of transfer belts tightly contacts both sides of the wood material in straight-line sections of the conveyor belt, and the pair of transfer belts is disposed a direction to transfer the wood material into the shaping channel via the moving belts. The pair of transfer belts sandwiches the wood material from both sides and movement of the opposing belts pushes it into the bending template shaping channel. Further, the driving mechanism may also be configured with a combination of driving piston, transfer rollers, and transfer belts.

The braking mechanism is provided with a pusher which can move in the shaping channel and limit movement of the front end of wood material in the shaping channel. The pusher moves along the shaping channel while pressing against the front end of the wood material to limit movement of the wood material. Wood material moving in the shaping channel while being pressed against by the pusher is compressed to avoid any stretching of distorted regions, or to limit stretching to a degree avoiding tension fracture. Tension fracture due to stretching of the outer periphery is prevented for wood material which is processed by moving in the shaping channel in this manner. Consequently, efficient bending of wood materials is possible while eliminating tension fracture. This method can process wood materials of various cross-sectional shapes with bending templates of various cross-sectional shapes to produce wood materials of diverse forms. In addition, by sliding wood material in a shaping channel with smooth surfaces, curved wood with fine surface properties and highly accurate dimensions can be manufactured.

The braking mechanism can most effectively control stretching of the curved outer periphery of wood material by synchronizing movement of the pusher with insertion of the wood material via the driving mechanism. A braking mechanism synchronized with the driving mechanism has a pusher which is moved by a smaller amount than the driving piston. However, the pusher moves together with the driving piston while keeping the outer side of the wood material being curved from stretching. The pusher holds wood material in the shaping channel in a compressed state. Therefore, the driving mechanism moves wood material into the shaping channel, and the pusher does not move until the rate of compression is high enough to avoid stretching the outside periphery of the wood material being shaped. After the compressed state has been reached, the pusher is moved an amount less than equal to the amount of driving piston movement.

To describe this with specific numbers, 400 mm long cylindrical shaped wood material having a cross-section 40 mm by 40 mm is processed with a curve having a 200 mm radius of curvature. In this case, bending around the 200 mm radius, assuming stretching at the outside periphery and compression at the inside periphery, results in stretching of the outside periphery near 10%. This is well above the wood material's stretching limit and tension fracture occurs. Here, the wood material stretching limit is 1% to 2%, and stretching beyond that results in tension fracture. When the braking mechanism limits movement of the front end of the wood material to keep its outside periphery from stretching, curved wood material outside periphery stretching stays below the stretching limit and tension fracture does not occur. When the braking mechanism limits movement of the front end of the wood material and compresses it to avoid outside periphery stretching, the inside periphery of the curved wood material is compressed. In this case when the wood material is compressed to avoid outside periphery stretching, its curved inside periphery is compressed to a maximum of about 20%. Compression within this range does not exceed the compression limit and is not a problem. The maximum compression limit in the grain direction of wood material is about 30%. Consequently, wood material bending is possible without exceeding the maximum compression limit at the inside periphery, and avoiding tension fracture with a radius of curvature that does not stretch of the outside periphery. A bending method with the braking mechanism and driving mechanism synchronized allows control of the amount of wood material compression and has the characteristic that wood material can be shaped in a curved manner by compressing the wood material without exceeding the maximum compression limit of the inside periphery.

The method of control may not synchronize the braking mechanism and the driving mechanism, but rather may control compression by wood material movement, namely by the moving position of the front end of the wood material. The braking mechanism may also apply a given amount of pressure to the front end of the wood material to control the state of compression. The braking mechanism may also adjust control of movement of the front end of the wood material considering frictional resistance between the wood material and the bending template shaping channel.

Figure 4:
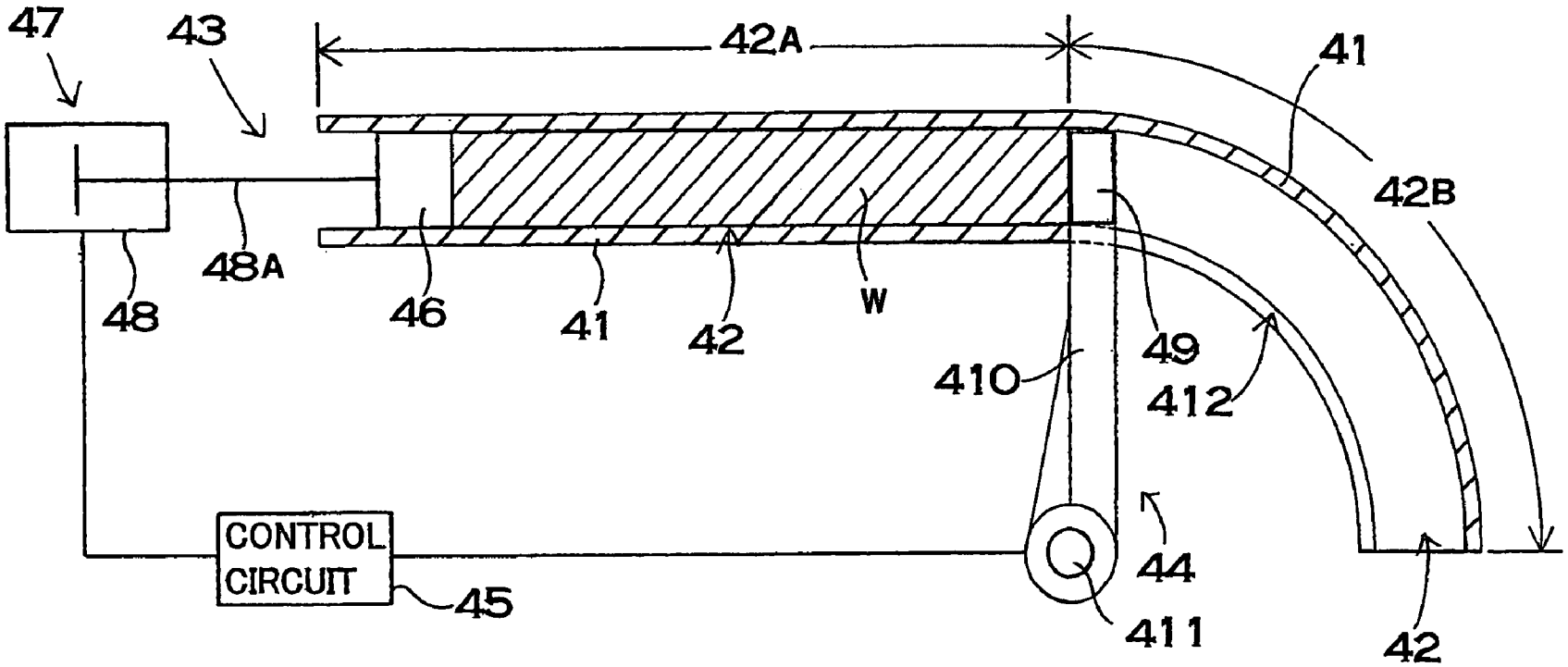
FIG. 4 is an abbreviated conceptual view of an apparatus for bending wood materials representing an embodiment of the present invention.
Figure 5:
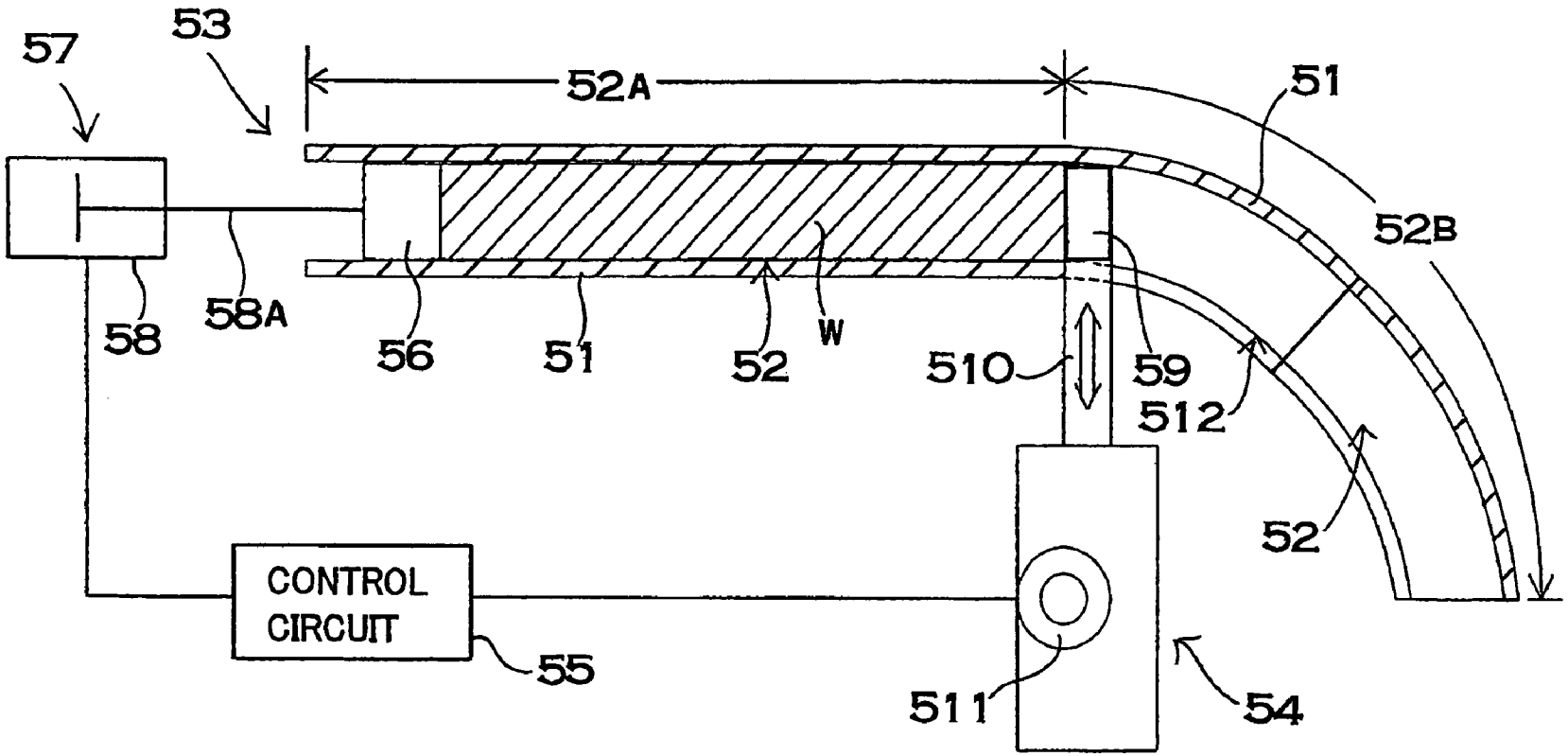
FIG. 5 is an abbreviated conceptual view of an apparatus for bending wood materials representing another embodiment of the present invention.

FIGS. 4 and 5 show abbreviated conceptual views of apparatus for bending wood materials. Each of these apparatus for bending wood materials is provided with a driving mechanism 43, 53 to push cylindrical shaped wood material W with the same cross-sectional shape into the bending template 41, 51 shaping channel 42, 52, a bending template 41, 51 to bend the wood material W into a specified shape, a braking mechanism 44, 54 to limit stretching of the wood material W being shaped by limiting its movement, and a control circuit 45, 55 to control the driving mechanism 43, 53 and the braking mechanism 44, 54.

The driving mechanism 43, 53 is provided with a driving piston 46, 56 which moves in the straight-line section 42A, 52A of the bending template 41, 51 shaping channel 42, 52 and pushes the aft end of wood material W to insert it into the shaping channel 42, 52, and an activating mechanism 47, 57 to move the driving piston 46, 56. The activating mechanism 47, 57 is provided with a driving cylinder 48, 58 to move the driving piston 46, 56. The driving cylinder 48, 58 is a hydraulic cylinder, and movement of the driving piston 46, 56 is controlled by controlling the flow rate of hydraulic fluid supplied to operate the driving cylinder 48, 58. The driving cylinder 48, 58 of this driving mechanism 43, 53 extends a rod 48A, 58A to push the driving piston 46, 56 connected to the end of the rod 48A, 58A into the bending template 41, 51 shaping channel 42, 52, and the driving piston 46, 56 pushes wood material W into the shaping channel 42, 52. The control circuit 45, 55 detects the change in position of the aft end of the wood material W moved by the driving piston 46, 56 of the driving mechanism 43, 53 and controls operation of the braking mechanism 44, 54.

Figure 6:
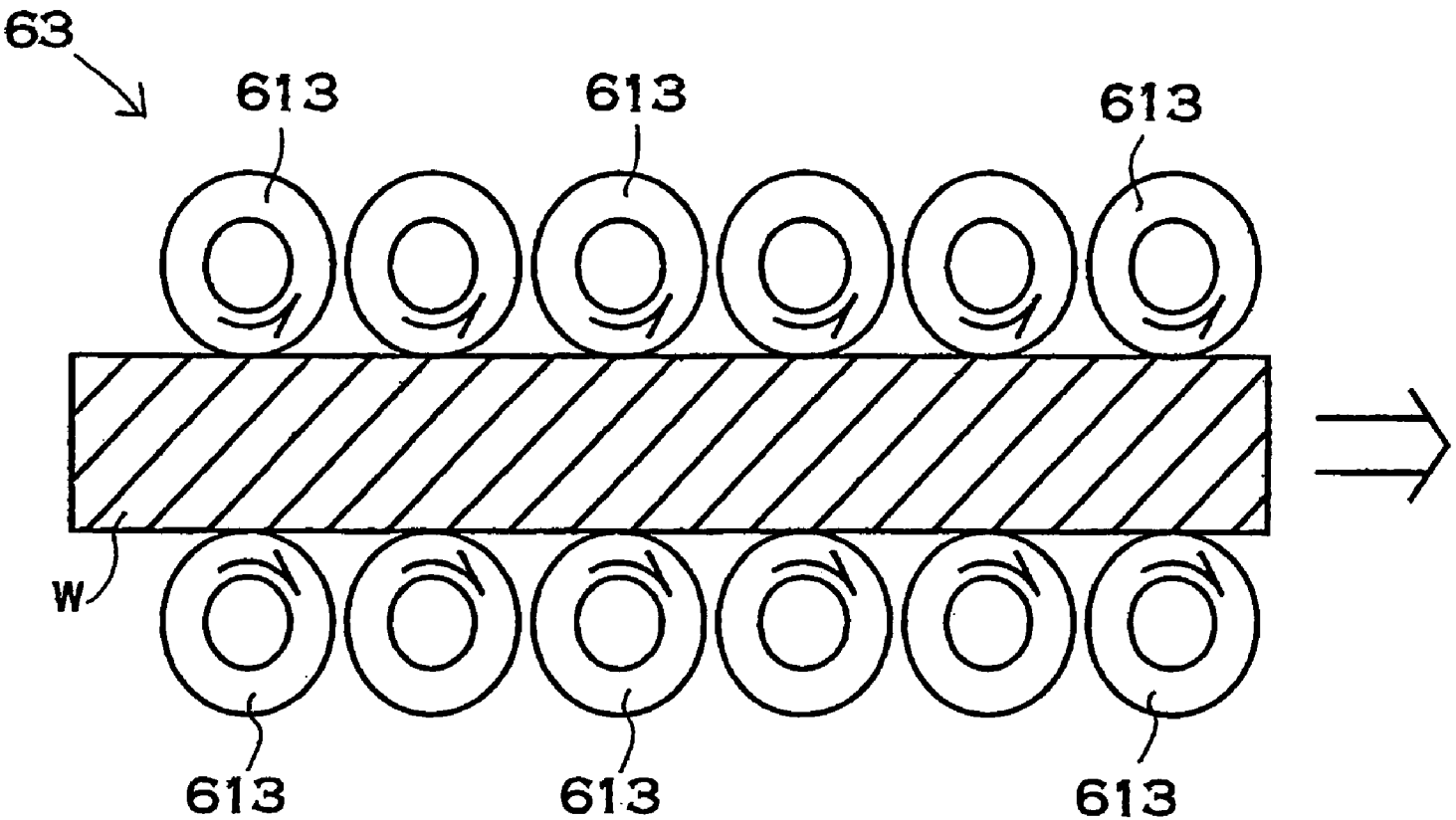
FIG. 6. is an abbreviated cross-section view showing another embodiment of a driving mechanism.

As shown in FIG. 6, the driving mechanism may also be configured as a plurality of transfer rollers 613. A plurality of transfer rollers 613 are arranged in parallel rows on both sides of the wood material W and are rotated by an activating mechanism (not illustrated) to transport the wood material W. The plurality of transfer rollers 613 are oriented with their axes perpendicular to the direction of wood material W movement and are disposed in a direction aligned with movement of wood material into the shaping channel. The gap between transfer rollers 613 disposed on opposite sides of the wood material W is adjusted approximately equal to, or slightly narrower than the thickness of the wood material W. In this type of driving mechanism 63, the plurality of transfer rollers 613 sandwich the wood material W from both sides, namely the transfer rollers 613 on opposite sides press against the sides of the wood material W, individual transfer rollers 613 are rotated in the directions shown in FIG. 6, and wood material W is pushed into the bending template shaping channel. The control circuit detects the change in position of the aft end of the wood material W, and controls operation of the braking mechanism.

Figure 7:
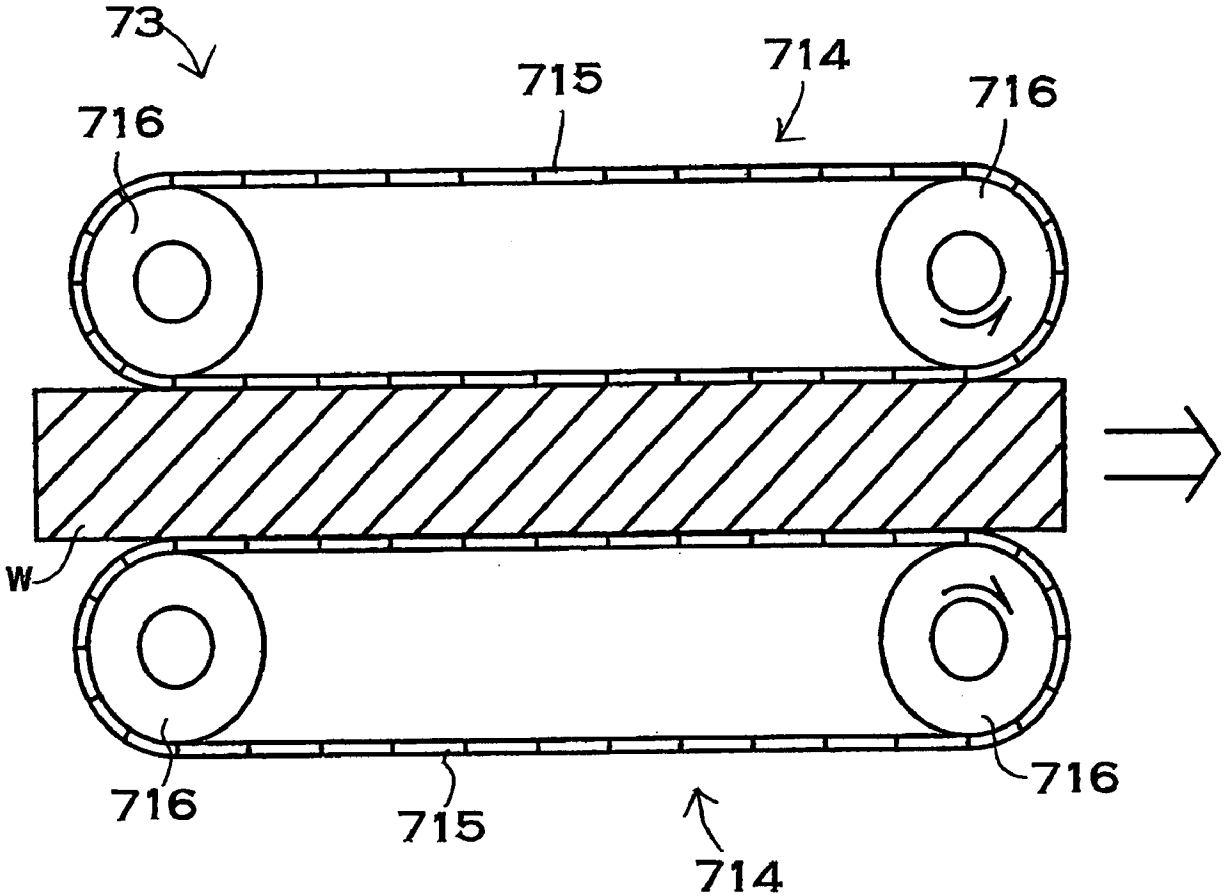
FIG. 7. is an abbreviated cross-section view showing another embodiment of a driving mechanism.

Further, as shown in FIG. 7, the driving mechanism 73 may also be configured as a pair of transfer belts 714. The transfer belts 714 shown in FIG. 7 comprise conveyor belts 715 moved by rollers 716 and are disposed on opposite sides of the wood material W. The pair of transfer belts 714 is disposed in a direction allowing movement of the conveyor belts 715 to transport wood material W into the shaping channel. In addition, the pair of transfer belts 714 are configured for tight contact of the straight-line section of the belts 715 on rollers 716 with the sides of the wood material W. Consequently, the gap between transfer belts 714 disposed on opposite sides of the wood material W is adjusted approximately equal to, or slightly narrower than the thickness of the wood material W. The pair of transfer belts 714 sandwiches wood material W on both sides with belts 715, and by moving those belts 715, wood material W is pushed into the bending template shaping channel. The control circuit detects the change in position of the aft end of the wood material W, and controls operation of the braking mechanism.

In the transfer roller 613 and transfer belt 714 configurations for inserting wood material W into a shaping channel described above, wood material W is moved while applying pressure via rollers or belts to its sides at a plurality of sites or over a wide region. Therefore, these systems have the characteristic that wood material W can be smoothly inserted into a shaping channel without unnecessary force.

Figure 8:
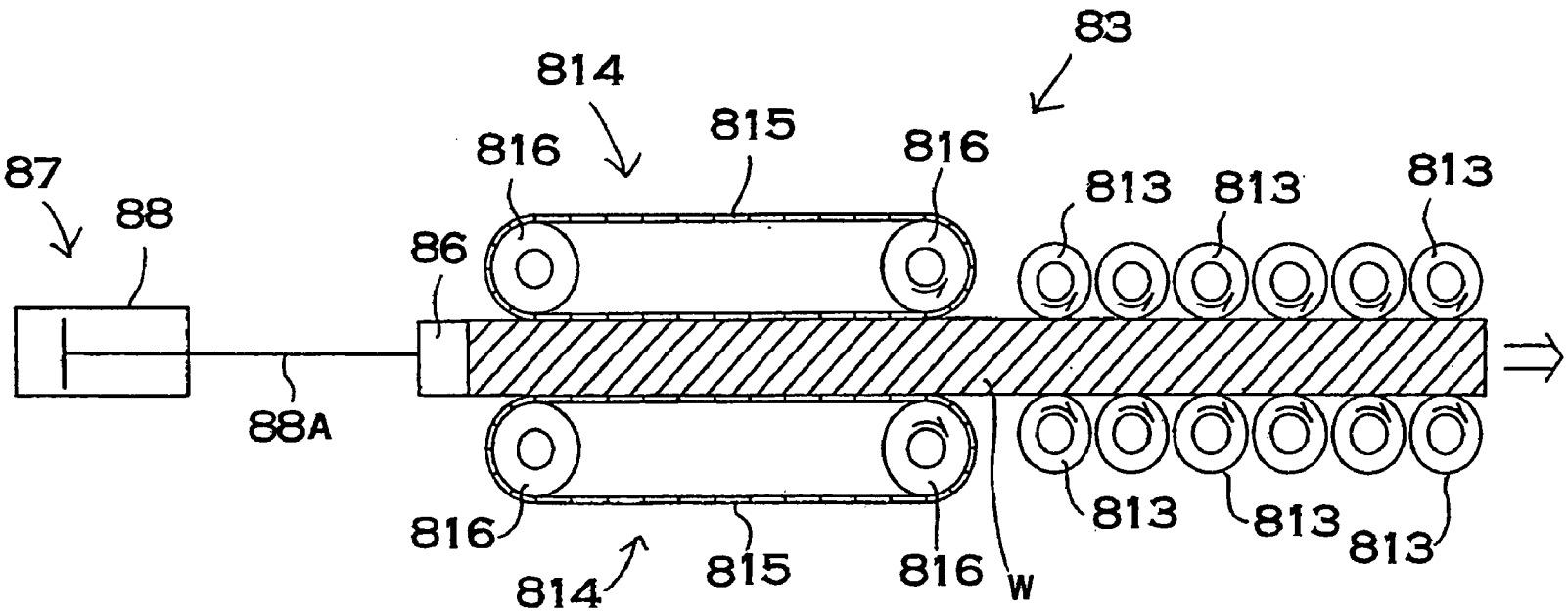
FIG. 8. is an abbreviated cross-section view showing another embodiment of a driving mechanism.

Still further, the driving mechanism may also be configured as a combination of driving piston, transfer rollers, and transfer belts. The driving mechanism shown in FIG. 8 has the transfer roller driving mechanism shown in FIG. 6, and the driving mechanism configured with a pair of transfer belts shown in FIG. 7 both disposed in a single straight-line. Furthermore, the driving mechanism shown in FIG. 8 has a driving piston 86 disposed at the aft end of the wood material W to apply pressure to the aft end of that wood material W. This driving piston 86 applies pressure to the aft end of the wood material W via an activating mechanism 87 which is a driving cylinder 88 and a rod 88A which extends. In the driving mechanism 83 of FIG. 8, transfer rollers 813 are disposed next to the shaping channel (not illustrated), but the transfer belts 814 may also be disposed next to the shaping channel (not illustrated) . In this driving mechanism 83, not only does the driving piston 86 push the aft end of wood material W in the shaping channel, but transfer rollers 813 and transfer belts 814 are activated while sandwiching both sides of the wood material W to transport it and push it into the shaping channel. This type of driving mechanism 83 has the characteristic that it can insert wood material W into the shaping channel in a more ideal fashion. In FIG. 8, 815 are conveyor belts and 816 are rollers.

The bending template 41, 51 is provided with a shaping channel 42, 52 for wood material W insertion. The shaping channel 42, 52 shown in FIGS. 4 and 5 is made up of a straight-line section 42A, 52A, and a curved section 42B, 52B to bend wood material W with a specified radius of curvature. A bending template 41, 51 with a shaping channel 42, 52 having a straight-line section 42A, 52A allows driving piston 46, 56 insertion into the straight-line section 42A, 52A to push wood material W into the shaping channel 42, 52. The bending template 41 of FIG. 4 has a curved section 42B with a uniform radius of curvature. The bending template 51 of FIG. 5 has a curved section 52B which is shaped with different radii of curvature in different regions.

In the bending template 41, 51 shown in FIGS. 4 and 5, wood material W inserted into the curved section 42B, 52B can be retained there in a stationary fashion for a specified time period to solidify its curved shape. In the bending template 41 of FIG. 4, wood material W can also be elected from the curved section 42B to produce the curved shape. Wood material W ejected from the curved section 42B is put in a shape retaining template for a specified period to preserve the shape that was formed. A method, which puts shaped wood material W in a shape retaining template to solidify that shape without further deformation, can bend wood material W into a variety of shapes.

A straight-line section of shaping channel does not necessarily have to be provided for a bending apparatus configured with transfer rollers or transfer belts as the driving mechanism. This is because transfer rollers and transfer belts can be disposed near the entrance to a curved section of the bending template and can insert wood material directly into the curved section. However, an apparatus for bending wood material may have a bending template shaping channel provided with a straight-line section, and may also insert wood material into that straight-line section with transfer rollers or transfer belts.

The braking mechanism 44, 54 is provided with a pusher 49, 59 which applies pressure to the front end of the wood material W to compress it. In the braking mechanism 44, 54 of FIGS. 4 and 5, the pusher 49, 59 is established at the end of a braking arm 410, 510, and the braking arm 410, 510 is connected to a braking device 411, 511. The pusher 49, 59 has an outline which is the same shape as, but slightly smaller than, the inside of the shaping channel 42, 52. This allows the pusher 49, 59 to apply pressure to the front end of the wood material W and slide smoothly along the inside surfaces of the shaping channel 42, 52. Gaps between the perimeter of the pusher 49, 59 and the inside of the shaping channel 42, 52 which would allow extrusion of wood material W are not established. This is because if wide gaps were established and wood material W extruded through the gaps, the front end of the wood material W would tension fracture. Gaps between the pusher 49, 59 and the shaping channel 42, 52 are preferably 0.2 mm to 5 mm. Wood material W with braking pressure applied does not extrude through gaps of this range of size.

The end of the braking arm 410, 510 inserts into the shaping channel 42, 52 through a lengthwise slit 412, 512 provided along the inside curved edge of the shaping channel 42, 52 of the bending template 41, 51. The braking device 411, 511 is controlled by the control circuit 45, 55 to control rotation of the braking arm 410, 510. This braking device 411, 511 rotates the braking arm 410, 510 in synchrony with the driving mechanism 43, 53 via a servo-motor or hydraulic device controlled by the control circuit 45, 55. This braking mechanism 44, 54 is synchronized with the driving mechanism 43, 53 and limits movement of the wood material W. The control circuit 45, 55 controls braking arm 410, 510 rotation to avoid stretching of the outer periphery of wood material W inserted in the curved section 42B, 52B of the shaping channel 42, 52 by pressing on the front end, and compressing the wood material W with the pusher 49, 59.

Since the curved section 52B of the shaping channel 52 of the bending template 51 of FIG. 5 has different radii of curvature in different regions, the braking arm 510 is configured to extend and contract along its length. The braking arm 510 extends and contracts to move the pusher 59 along the curved section 52B with different radii of curvature.

The control circuit 45, 55 actuates the driving mechanism 43, 53 and the braking mechanism 44, 54 in synchrony. For example, the control circuit 45, 55 moves the driving piston 46, 56 of the driving mechanism 43, 53 at a constant speed, and controls movement of the pusher 49, 59 of the braking mechanism 44, 54 synchronous with the change in position of the driving piston 46, 56. At this point, movement of the braking mechanism 44, 54 pusher 49, 59 is controlled to keep all regions of the wood material W from stretching. In the bending apparatus described above, distance moved by the pusher 49, 59 can be controlled to reliably prevent stretching of wood material W inserted in the shaping channel 42, 52 of the bending template 41, 51.

However, the bending apparatus of the present invention can also bend wood material W by applying a specified amount of pressure via the braking mechanism 44, 54 to the front end of wood material W moving in the shaping channel 42, 52 to control its movement and avoid stretching. This type of braking mechanism 44, 54 applies pressure to the front end of the wood material W with the pusher 49, 59 and controls its movement by applying braking action to the rotation of the braking arm 410, 510. Increasing pressure of the pusher 49, 59 on the front end of the wood material W reduces wood material W stretching, and decreasing pusher 49, 59 pressure increases the amount of wood material W stretching. If the braking force applied to rotation of the braking arm 410, 510 is increased, the amount of pressure applied to the front end of the wood material W by the pusher 49, 59 increases. Consequently, the braking device 411, 511 controls the braking force applied to the rotating braking arm 410, 510 to control the amount of pressure applied to the front end of the wood material W by the pusher 49, 59 and make adjustments to avoid wood material W stretching.

A braking mechanism 44, 54, which has a pusher 49, 59 that applies a specified amount of pressure to the front end of the wood material W to control its movement, can apply different braking forces to the rotating braking arm 410, 510 in different regions. The pusher 49, 59 can initially apply strong pressure to the front end of the wood material W, and subsequently reduce the amount of pressure applied. This is because frictional resistance between the wood material W and the curved section 42B, 52B of the shaping channel 42, 52 increases as the wood material W is inserted into the curved section 42B, 52B. Frictional resistance between the wood material W and the curved section 42B, 52B of the shaping channel 42, 52 limits movement of the wood material W. Consequently, the further the wood material W is inserted into the curved section 42B, 52B, the more its movement is limited. Movement of the front end of the wood material W is limited by both frictional resistance between the wood material W and the curved section 42B, 52B, and by pressure of the pusher 49, 59 against the front end of the wood material W. Therefore, the pusher 49, 59 can initially press strongly against the front end of the wood material W when frictional resistance is low, and reduce the amount of pressure it applies to the front end of the wood material W as the frictional resistance increases. This allows wood material W to be inserted into the curved section 42B, 52B of the shaping channel 42, 52 while compressing all parts of the wood material W, namely avoiding stretching of the outer periphery with bending.

The apparatus for bending wood materials described above processes wood material by the following steps. Wood material inserted into the bending template 41, 51 is pre-processed by a heat treatment step from 100° C. to 180° C. for pliability processing. Wood material can be heat treated at high pressure in an air tight sealed container. Namely, it can be heated at 100° C. or higher in an autoclave.

The pusher 49, 59 is disposed at the front region of the curved section 42B, 52B of the shaping channel 42, 52, and the driving mechanism 43, 53 inserts wood material W, processed to improve pliability, into the bending template 41, 51 shaping channel 42, 52. When the front end of the wood material W contacts the braking mechanism 44, 54 pusher 49, 59, the driving mechanism 43, 53 further inserts the wood material W into the curved section 42B, 52B while the pusher 49, 59 applies a prescribed amount of pressure against the front end of the wood material W, or while pusher 49, 59 movement is controlled. At this point, the braking mechanism 44, 54 controls the amount of pusher 49, 59 movement or pusher 49, 59 pressure against the wood material W to keep the outer periphery of the wood material W from stretching during the bending process. Wood material W is inserted into the curved section 42B, 52B while being compressed by the braking mechanism 44, 54 pusher 49, 59. This keeps the outer periphery of the wood material W from stretching during the bending process, or in other words, keeps all parts of the wood material W from stretching. After compressing the wood material W to keep it from stretching even with the bending process, the braking mechanism 44, 54 may move the pusher 49, 59 to insert the wood material W into the curved section 42B, 52B.

Wood material W inserted into the curved section 42B, 52B undergoes bending there. Wood material W inserted into the curved section 42B, 52B is cooled while being held in the curved section 42B, 52B to retain its curved shaped. However, the wood material W may also be ejected from the curved section 42B, 52B while being compressed, and subsequently inserted in a shape retaining template and cooled to maintain its curved shape.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims or equivalence of such meets and bounds thereof are therefore intended to be embraced by the claims.

What is claimed is:

1. A method of bending wood materials wherein cylindrical or board shaped wood material of uniform lateral cross-section is inserted into a bending template shaping channel by a driving mechanism, and the wood material is processed by bending in the shaping channel;

and wherein pressure is applied to the front end of the wood material and its movement in the shaping channel is controlled by a braking mechanism, and the wood material undergoing bending is compressed to control the amount of stretching of the extended outer periphery of the wood material.

2. A method of bending wood materials as o recited in claim 1 wherein the wood material is processed to make it more pliable and inserted into the bending template shaping channel.

3. A method of bending wood materials as recited in claim 2 wherein the wood material is heat treated to make it more pliable.

4. A method of bending wood materials as recited in claim 2 wherein the wood material is heat treated at 100° C. to 180° C. to make it more pliable.

5. A method of bending wood materials as recited in claim 1 wherein wood material shaped in the shaping channel is cooled in the shaping channel to retain its curved shape.

6. A method of bending wood materials as recited in claim 1 wherein wood material ejected from the shaping channel is put in a shape retaining template and cooled to maintain its curved shape.

7. A method of bending wood materials as recited in claim 1 wherein wood material inserted in the bending template is inserted into the shaping channel while being heated.

8. An apparatus for bending wood materials comprising a bending template having a shaping channel for inserting and bending cylindrical or board shaped wood material of uniform lateral cross-section, a driving mechanism to apply pressure to the wood material and insert the wood material into the bending template shaping channel, and a braking means for applying pressure to the front end of the wood material inserted into the bending template shaping channel by the driving mechanism and controlling movement of the wood material in the shaping channel;

and wherein the driving mechanism pushes the wood material into the bending template shaping channel, while the braking means is applying pressure to the front end of the wood material and controlling the amount of stretching of the wood material undergoing bending, and the wood material is ejected from the shaping channel.

9. An apparatus for bending wood materials as recited in claim 8 wherein the driving mechanism is a driving piston which applies pressure to the wood material from its aft region.

10. An apparatus for bending wood materials as recited in claim 9 wherein the driving piston applies pressure to the entire surface of the aft end of the wood material to push it into the bending template shaping channel.

11. An apparatus for bending wood materials as recited in claim 8 wherein the driving mechanism is an arm structure with a pressure piece at the end of the arm inserted into the bending template shaping channel, and the pressure piece of the arm applies pressure to the wood material to insert it into the shaping channel.

12. An apparatus for bending wood materials as recited in claim 8 wherein the driving mechanism is transfer rollers which are driven while sandwiching the wood material from both sides, and the transfer rollers sandwich the wood material from both sides and are rotated to push the wood material into the bending template shaping channel.

13. An apparatus for bending wood materials as recited in claim 8 wherein the driving mechanism is transfer belts which are driven while sandwiching the wood material from both sides, and the transfer belts sandwich the wood material from both sides and are driven to push the wood material into the bending template shaping channel.

14. An apparatus for bending wood materials as recited in claim 8 wherein the braking mechanism is synchronized with the driving mechanism to limit wood material movement.

15. An apparatus for bending wood materials as recited in claim 14 wherein the braking mechanism, which moves in synchrony with the driving mechanism, moves the front end of the wood material an amount equal or less than the amount of movement of the driving piston.

16. An apparatus for bending wood materials as recited in claim 8 wherein the braking mechanism applies a prescribed amount of pressure to the front end of the wood material moving in the shaping channel to limit wood material movement.

17. An apparatus for bending wood materials as recited in claim 8 wherein the driving mechanism is provided with a driving piston, and the section of the bending template shaping channel where the driving piston inserts wood material is a straight-line section.

18. An apparatus for bending wood materials as recited in claim 8 wherein the braking mechanism moves along the shaping channel while applying pressure to the front end of the wood material, the braking mechanism compresses wood material moving in the shaping channel to avoid stretching any part of the wood material being deformed, or it limits stretching to the degree that tension fracture does not occur, and prevents tension fracture due to stretching of the extended outer periphery of the wood material undergoing bending.

19. An apparatus for bending wood materials as recited in claim 8 wherein the shaping channel has a circular arc section to bend wood material into a circular arc shape.

20. An apparatus for bending wood materials comprising a bending template having a shaping channel for inserting and bending cylindrical or board shaped wood material of uniform lateral cross-section, a driving mechanism to apply pressure to the wood material and insert the wood material into the bending template shaping channel, and a braking mechanism to apply pressure to the front end of the wood material inserted into the bending template shaping channel by the driving mechanism and control movement of the wood material in the shaping channel, and means for controlling the braking mechanism to control the amount of stretching of the wood material undergoing bending, and wherein the wood material is ejected from the shaping channel.

* * * * *